United States Patent [19]

McDonald et al.

[11] Patent Number: 4,707,843

[45] Date of Patent: Nov. 17, 1987

[54] RELATING TO MICROPROCESSOR CONTROLLED CASH COUNTING APPARATUS

[75] Inventors: Ronald McDonald, Milford; John A. Hengeveld, Framingham, both of Mass.

[73] Assignee: American Coin Currency Equipment Corporation, Dorchester, Mass.

[21] Appl. No.: 730,238

[22] Filed: May 3, 1985

[51] Int. Cl.[4] ..... G06M 7/00

[52] U.S. Cl. ..... 377/8

[58] Field of Search ..... 377/8; 364/405; 271/3, 271/262, 263; 355/14 CU; 340/674

[56] References Cited

U.S. PATENT DOCUMENTS

| | | | |
|---|---|---|---|
| 4,015,110 | 3/1977 | Jones | 377/8 |
| 4,123,649 | 10/1978 | Strunc | 377/8 |
| 4,128,756 | 12/1978 | Nagano et al. | 377/8 |
| 4,231,014 | 10/1980 | Ponzio | 377/8 |
| 4,255,651 | 3/1981 | Phillips | 377/8 |
| 4,418,417 | 11/1983 | Uchida et al. | 377/8 |
| 4,514,856 | 4/1985 | Asai et al. | 377/8 |
| 4,532,641 | 7/1985 | Nishimura | 377/8 |
| 4,608,704 | 8/1986 | Sherman, III et al. | 377/8 |

*Primary Examiner*—Stanley D. Miller
*Assistant Examiner*—Karl Ohralik

[57] ABSTRACT

A cash counting machine including a bill feed mechanism that transfers bills individually from an input hopper to an output tray including a microprocessor control system. The machine operates in two modes, including a batch mode in which it transfers a selected number of bills, as selected by an operator, to the output tray, and a count mode in which it transfers all of the bills to the output tray and keeps a running count of the number of bills, as well as the total value of money if the operator has entered a denomination value. The microprocessor also determines whether the bills are of the proper size. In an alternate embodiment, for use with currencies in which the different denominations have different sizes, the microprocessor determines the size of the bills and their respective denominations.

14 Claims, 18 Drawing Figures

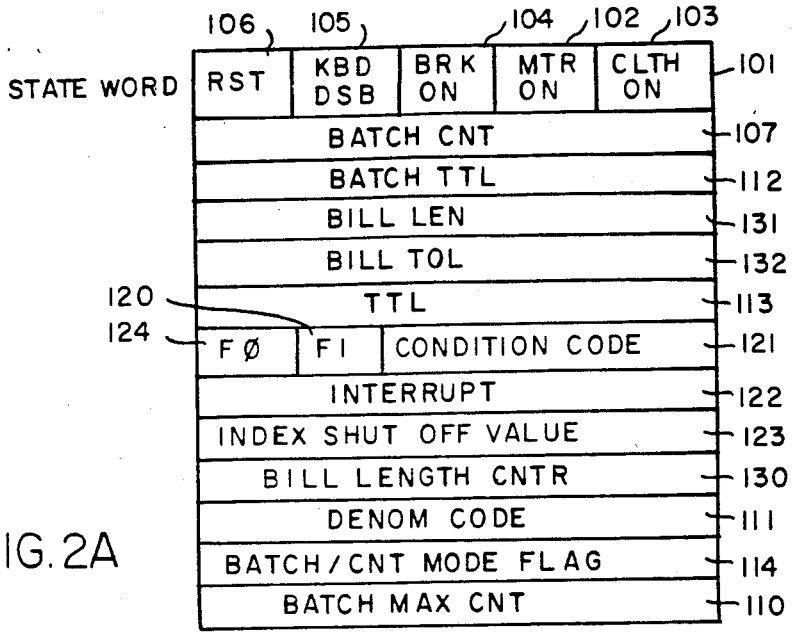
FIG. 2A
| CONDITION CODES | CONDITION |
|---|---|
| Ø | START OR STOP KEY DEPRESSED |
| 1 | BATCH OPERATION COMPLETE |
| 2 AND 3 | LONG AND NARROW BILL ERRORS |
| 4 | STOP KEY DEPRESSED WHILE ERROR BEING SERVICED |
| 5 | STOP KEY DEPRESSED |
FIG. 2B
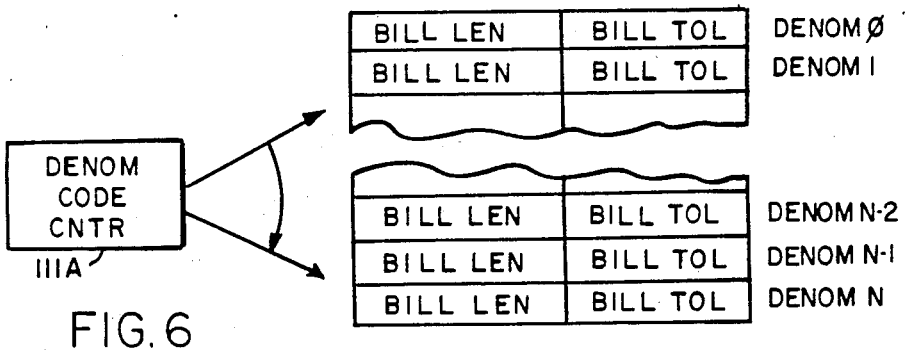
FIG. 6

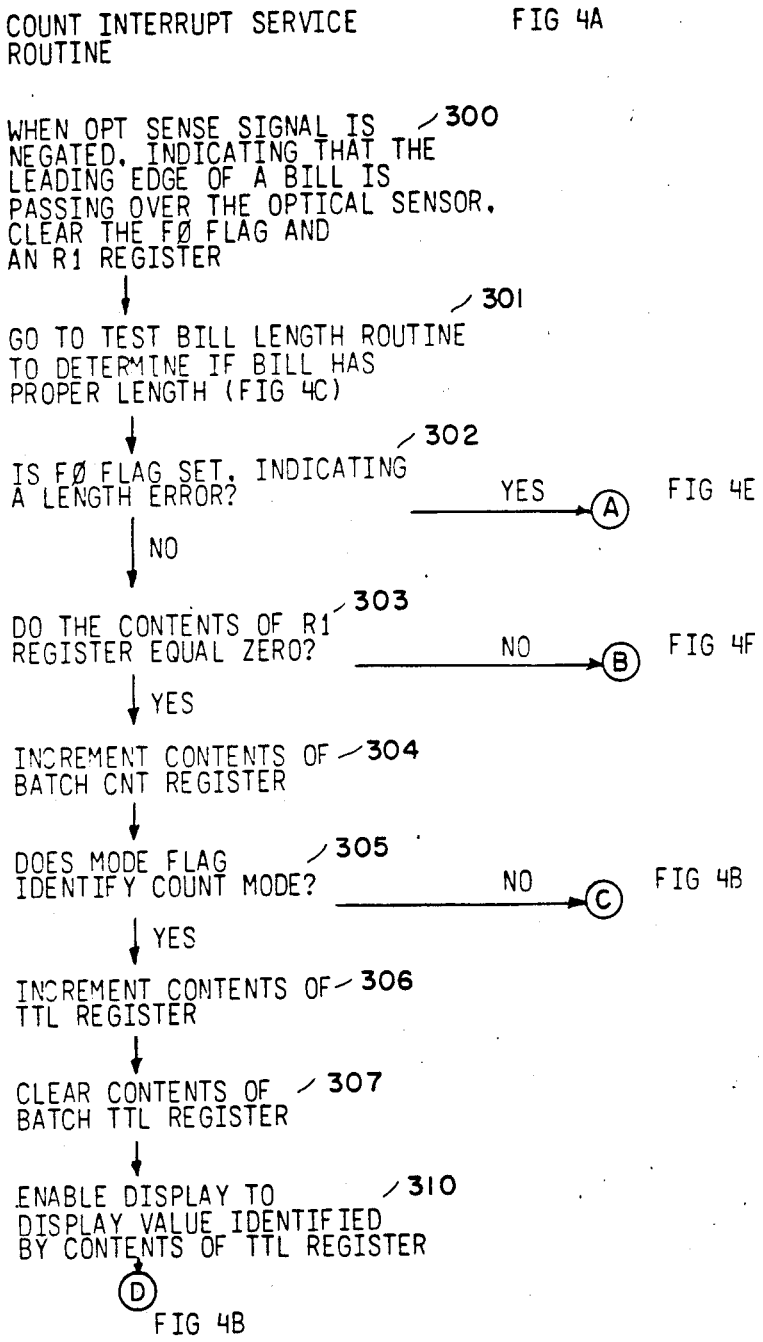
COUNT INTERRUPT SERVICE ROUTINE
FIG 4A
WHEN OPT SENSE SIGNAL IS NEGATED, INDICATING THAT THE LEADING EDGE OF A BILL IS PASSING OVER THE OPTICAL SENSOR, CLEAR THE FØ FLAG AND AN R1 REGISTER
300
GO TO TEST BILL LENGTH ROUTINE TO DETERMINE IF BILL HAS PROPER LENGTH (FIG 4C)
301
IS FØ FLAG SET, INDICATING A LENGTH ERROR?
302
YES
A
FIG 4E
NO
DO THE CONTENTS OF R1 REGISTER EQUAL ZERO?
303
NO
B
FIG 4F
YES
INCREMENT CONTENTS OF BATCH CNT REGISTER
304
DOES MODE FLAG IDENTIFY COUNT MODE?
305
NO
C
FIG 4B
YES
INCREMENT CONTENTS OF TTL REGISTER
306
CLEAR CONTENTS OF BATCH TTL REGISTER
307
ENABLE DISPLAY TO DISPLAY VALUE IDENTIFIED BY CONTENTS OF TTL REGISTER
310
D
FIG 4B

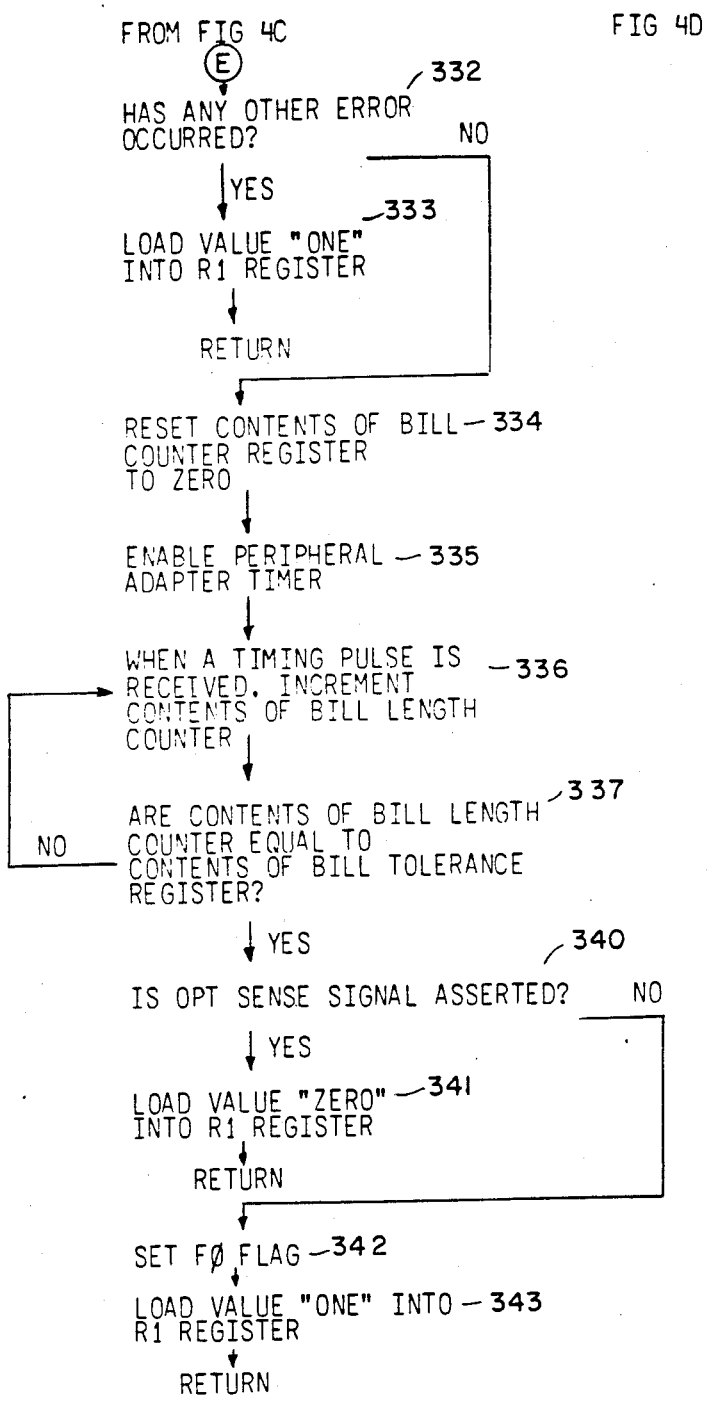
FIG 4D
FROM FIG 4C
E
HAS ANY OTHER ERROR OCCURRED?
332
NO
YES
LOAD VALUE "ONE" INTO R1 REGISTER
333
RETURN
RESET CONTENTS OF BILL COUNTER REGISTER TO ZERO
334
ENABLE PERIPHERAL ADAPTER TIMER
335
WHEN A TIMING PULSE IS RECEIVED, INCREMENT CONTENTS OF BILL LENGTH COUNTER
336
ARE CONTENTS OF BILL LENGTH COUNTER EQUAL TO CONTENTS OF BILL TOLERANCE REGISTER?
337
NO
YES
IS OPT SENSE SIGNAL ASSERTED?
340
NO
YES
LOAD VALUE "ZERO" INTO R1 REGISTER
341
RETURN
SET FØ FLAG
342
LOAD VALUE "ONE" INTO R1 REGISTER
343
RETURN

FROM FIG 4E
F

STOP TIMER
363
DISABLE INTERRUPTS
364
ENABLE DISPLAY TO DISPLAY ERROR MESSAGE "LONG"
365
G

B
FROM FIG 4A
STOP TIMER
366
DISABLE INTERRUPTS
367
CLEAR F1 FLAG
370
H

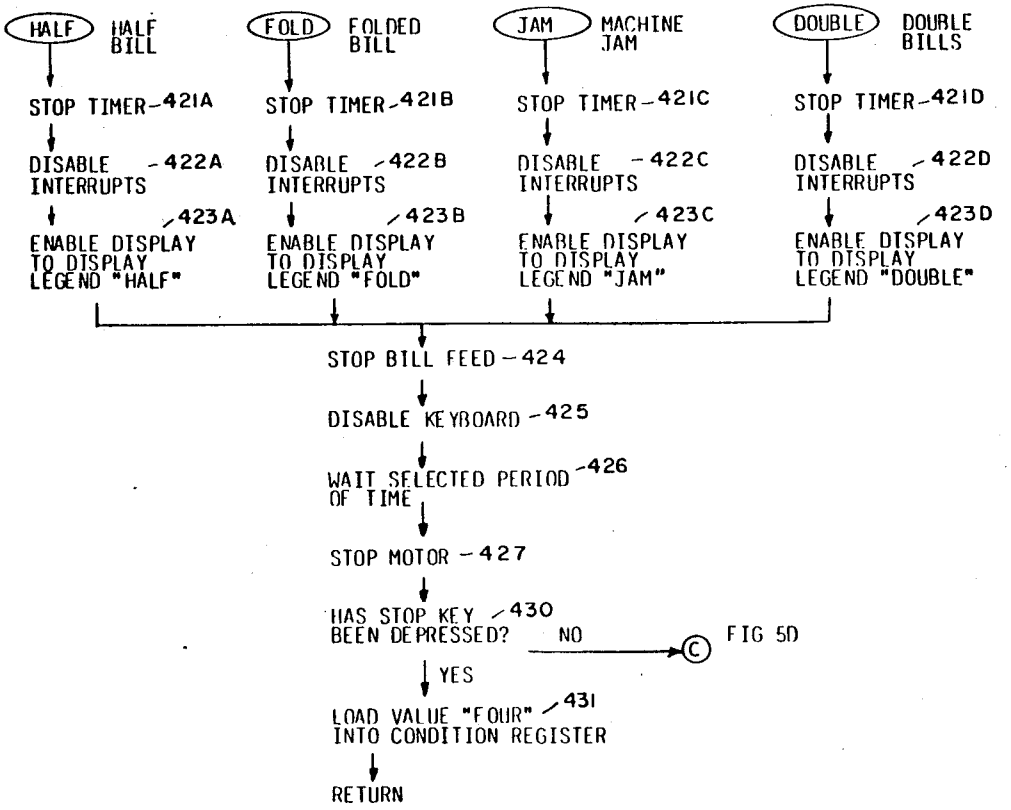
FIG 5C
HALF
HALF BILL
STOP TIMER-421A
DISABLE INTERRUPTS -422A
ENABLE DISPLAY TO DISPLAY LEGEND "HALF" -423A
FOLD
FOLDED BILL
STOP TIMER-421B
DISABLE INTERRUPTS -422B
ENABLE DISPLAY TO DISPLAY LEGEND "FOLD" -423B
JAM
MACHINE JAM
STOP TIMER-421C
DISABLE INTERRUPTS -422C
ENABLE DISPLAY TO DISPLAY LEGEND "JAM" -423C
DOUBLE
DOUBLE BILLS
STOP TIMER-421D
DISABLE INTERRUPTS -422D
ENABLE DISPLAY TO DISPLAY LEGEND "DOUBLE" -423D
STOP BILL FEED-424
DISABLE KEYBOARD-425
WAIT SELECTED PERIOD OF TIME -426
STOP MOTOR -427
HAS STOP KEY BEEN DEPRESSED? -430
NO
C
FIG 5D
YES
LOAD VALUE "FOUR" INTO CONDITION REGISTER -431
RETURN

RELATING TO MICROPROCESSOR CONTROLLED CASH COUNTING APPARATUS

BACKGROUND OF THE INVENTION

The invention relates generally to apparatus for counting sheet material such as paper currency, and more specifically to microprocessor controlled apparatus therefor.

Cash counting machines are used in banks and other financial institutions to perform a number of vital functions, most notably to count the number of bills in a stack. It is desirable not only to have the machines keep a running total of the number of bills in a stack, but also to count out a selected numbers of bills so that an operator may easily form stacks of either a preselected number of bills or of selected amount of money. Furthermore, in some countries, bills of different denominations have different lengths, and it is desirable to have the currency counter sense the different denominations and therefrom maintain running totals of the amount of money being counted.

The instant invention provides a microprocessor controlled currency counting apparatus including a conventional cash feeding mechanism including an input hopper, a toothed rotatable wheel and an output tray. The wheel is rotated by a motor and clutch arrangement under control of the microprocessor. Sheets or bills from the input hopper are individually fed to the wheel and caught between the teeth and deposited in the output hopper as the wheel is rotated.

The operations of the invention depend on which of several operating modes it is engaged in. In a batch mode, the invention transfers selected numbers of bills from the input hopper to the output tray for removal by an opeator. In a count mode, it transfers all of the bills from the input hopper to the output hopper and maintains a running total of the number of bills transferred by incrementing a counter after each bill is transferred.

The apparatus has optical sensors which perform several functions. In the output path from the input hopper, an optical sensor senses each bill passing over it to the wheel. The microprocessor determines the amount of time required for the bill to pass over it and, in response thereto, determines whether the bill is shorter or longer than a standard bill, which can assist in detecting counterfeit currency. This sensor also is useful in determining when the input hopper is empty and in detecting the value of a bill when used to count currency whose denominations are represented by bills of various sizes.

Other sensors in the feeding mechanism determines whether the output tray is empty, or whether an error has occurred, which occurs if the machine tries to feed a half bill, a folded bill, or two bills at one time, or if the feeding is jammed.

The machine includes a display which identifies the status of the machine, and also identifies the total amount of money in each stack transferred from the input hopper to the output tray, and also a running total of the value of money that has been fed through the machine.

BRIEF DESCRIPTION OF THE DRAWINGS

The invention will be pointed out with particularity in the appended claims. The above and other advantages of the invention may be better understood by referring to the following description taken in conjunction with the accompanying drawings, in which:

FIG. 2A is a memory map detailing items of information used by the microprocessor in performing various functions and FIG. 2B is a table useful in understanding a portion of FIG. 2A;

FIG. 4, comprising FIGS. 4A through 4F, is a flow diagram detailing the operations performed by the microprocessor when a bill is transferred from the input hopper to the output tray;

FIGS. 5A through 5D detail operations performed by the apparatus depicted in FIG. 1 is response to a key stroke or error; and FIG. 6 is a diagram useful in understanding the operations performed by an embodiment of the invention which identifies the denominations of bills in response to their lengths.

DETAILED DESCRIPTION OF AN ILLUSTRATIVE EMBODIMENTS

Figure 1:
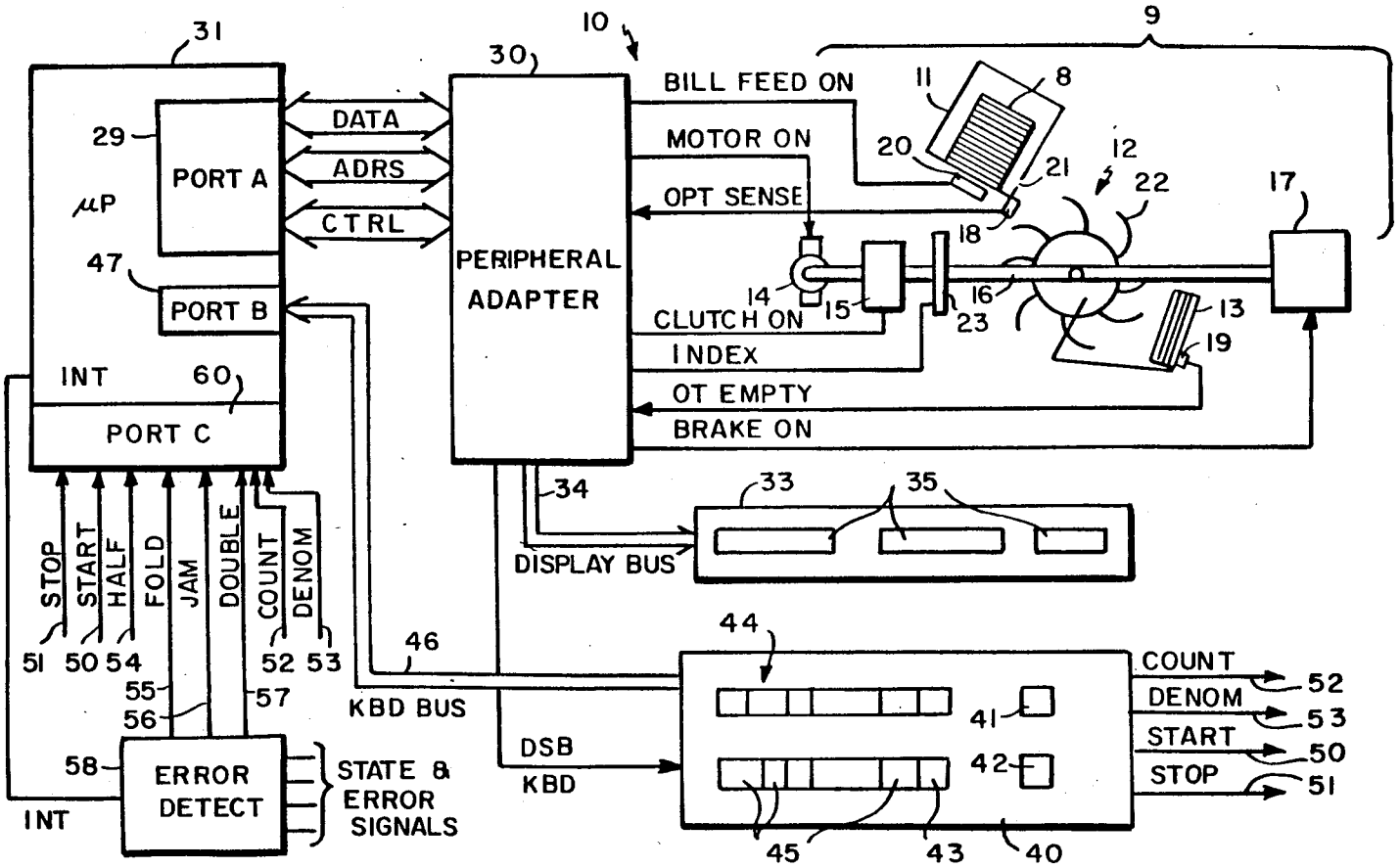
FIG. 1 is a schematic illustration of a currency counter constructed in accordance with this invention.

With reference to FIG. 1, a currency counting system 10 includes a bill feeding mechanism 9 having an input hopper 11 which holds a vertical stack of bills to be counted, a wheel 12 and an output tray 13, all of which are conventional. The wheel is rotated by a motor 14 through a clutch 15 and a shaft 16. A brake 17 also attached to the shaft 16 can stop wheel 12 from rotating. The clutch can disengage shaft 16 from motor 14 when it is desired to apply brake 17 to stop rotation of the wheel. A stack of bills 8 is deposited vertically in the hopper, with the plane of the bills being generally horizontal. When in operation, a reciprocable bill feed 20 at the bottom of hopper 11 slides the lowermost bill in the stack in the hopper longitudinally through a slot 21 in the side of hopper 11 towards wheel 12. The bill is then caught between teeth 22 of the wheel. The bill feed 20 then retracts to feed the next bill between the next pair of teeth 22. Each pair of teeth receives one bill from hopper 11. As the wheel rotates, the bills travel clockwise (as depicted in FIG. 1) and, are deposited in output tray 13. The bills are deposited so that their planes are generally vertical to form a generally horizontal stack.

The motor 14, clutch 15, and brake 17 and bill feed 20 are all controlled by respective MOTOR ON, CLUTCH ON, BRAKE ON and BILL FEED ON signals from a peripheral adapter 30 which, in turn is controlled by and receives data, address and signals from a port A29 of microprocessor 31. The sensor 23 includes, in one embodiment, an optically encoded disk and an optical sensor which senses each complete revolution of shaft 16 and transmits an INDEX signal when the shaft has a selected angular orientation. The INDEX signal is received in peripheral adapter 30.

The peripheral adapter 30 also controls an LED display 33 by transmitting enabling signals over a display bus 34. The display includes several sets of readouts 35 for displaying various types of information, such as, an operational mode, the denominations of the bills being counted, the number of bills and the total value of the bills in the output tray or which have been counted since the initialization of the machine.

In addition, the system 10 also includes a keyboard 40 which includes a stop key 41, a start key 42, a COUNT key 43 which enables the device to operate in a COUNT mode, and a plurality of batch quantity keys 45. If the COUNT key has not been depressed since a batch quantity was last depressed the system operates in a COUNT mode. The operations performed by the system in the various modes will be described below. The keyboard 40 also includes a set of denomination keys 44 which an operator uses to specify the denominations of the bills placed in hopper 11. If the device is in a COUNT mode, which occurs if key 43 has been depressed, the system counts all of the bills in hopper 11 and transfers them to output tray 13.

The key signals from COUNT key 43, of denomination keys 44 and batch quantity keys 45 are transmitted over a keyboard bus 46 to a port B47 of microprocessor 31 when a DSB KBD disable keyboard signal from peripheral adapter 30 is not asserted. When the start key 42 or the stop key 41 is depressed the keyboard 40 transmits a corresponding start signal on line 50 or the stop signal on line 51 to microprocessor 31 regardless of the state of the DSB KBD. The COUNT SIGNAL resulting from the depression of key 43 is transmitted to microprocessor over line 52, and, if any of buttons 44 are depressed, a DENOM denomination signal over line 53, is transmitted directly to a port C60 of microprocessore 31. The signals on lines 52 and 53 can be disabled by te DSB KBD signal.

In addition TO THE START, STOP, BATCH and DENOM signals on lines 50–53, four other signals, namely a HALF signal on line 54, a FOLD signal on line 55, a JAMB signal on line 56, and a DOUBLE signal on line 57 are received in port C 60 of microprocessor 31. The signals on lines 54 through 57 are generated by an error detection circuit 58, which receives state signals from sensors (not shown) in the device 10. Detection circuit 58 also generates an INT REQ interrupt request signal which is coupled to an interrupt terminal (INT) on microprocessor 31. The HALF signal indicates that a bill passing through the mechanism has been torn in half. The FOLD signal, when asserted, indicates that the bill is folded. The JAMB signal on line 56, when asserted, indicates either that bills are jammed in the feeding mechanims 9 or that a questionalbye bill has passed therethrough. The DOUBLE signal on line 57, when asserted, indicates that two bills are passing through feeding mechanism 9. In response to the INT REQ signal, the microprocessor performs interrupt service as described in connection with FIGS. 5A through 5D below.

The feeding mechanism 9 includes an optical sensor 18 at the output slot 21 of hopper 11, and a second optical sensor 19 associated with the output tray. Optical sensor 18 transmits an OPT SENSE optical sense signal to peripheral adapter 30. When a bill is passig over sensor 18, the signal is negated, and when it is exposed to light, the signal is asserted.

Similarly, sensor 19 transmits an OT EMPTY output tray empty signal when it is not blocked by bills in output tray 13. When the tray is empty, the OT EMPTY signal is asserted, otherwise the signal is negated.

Microprocessor 31 controls the operations of device 10 in the various modes. The operations will be described below in connection with FIGS. 3A through 5D.

The microprocessor 31, in response to the keys which an operator has depressed in keyboard 40, controls the rest of system 10. In doing so, the microprocessor makes use of several data structures depicted in FIG. 2A. A state word 101 includes a plurality of fields which identify the state of certain portions of the system. The state word includes a MTR ON motor on field 102, a CLTH ON clutch on field 103 and a BRK ON braked on field 104 which indicate whether the respective motor 14, clutch 15, or brake 17 is on or off. Specifically, when the contents of the respective field is set to a value of "1", the MOTOR ON signal, CLUTCH ON, and BRAKE ON signals are asserted turning on the respective motor, clutch, or brake. The state word also includes a KBD DSB keyboard disable field 105 to indicate that the DSB KDB disable keyboard signal is being asserted by peripheral adapter 30 (FIG. 1). An RST reset flag is set when the microprocessor is undergoing a reset or system initialization operation.

Microprocessor 31 also uses a batch count word 107 to indicate the number of bills which have been fed through feeding mechanism 9 since it has been reset, and a batch maximum count word 110 to identify the maximum number of bills to be fed through in each batch. As has been noted, the system 10 operates in two modes, namely, a batch mode and a count mode. In a batch mode, the operator identifies the number of bills to be transferred from input hopper 11 to output tray 13 by depressing one of keys 44. The value, identified by te depressed key 44 is passed over keyboard bus 46 and stored in the batch maximum count word 110.

The operator may also depress one of keys 45 to identify the denomination of the bills placed in input hopper. A code representing the denomination is passed over keyboard bus 46 and stored in a denomination code word 111 (FIG. 2A). A batch total word 112 stores the total value of the bills which have been passed to output tray 13 and are awaiting removal by an operator. A total word 113 identifies the total amount of currency which has been counted during an operation. Thus, if the device 10 is in a batch mode, and a large stack of currency is deposited into hopper 11 to be divided into stacks each containing a selected number of bills, after the entire stack has been fed to output tray 13, the batch total word 112 will identify the total amount of currency in each stack and the total word 113 will identify the total amount of curency contained in all of the stacks.

The mode in which the device 10 is operating is identified by a batch/count mode flag 114 (FIG. 2A). The state of this flag is determined by whether a COUNT signal has been received on line 52 since a batch quantity key 45 has been depressed.

The microprocessor also uses two other control flags, An F1 flag 120 is used to identify whether a start signal has been received on line 50. When the F1 flag is set, a condition key has occurred. The several conditions which may occur which can result in the F1 flag being set will be detailed below. An F0 flag 124 is used to identify certain selected errors as described below.

A condition code register 121 contains a condition code which identifies one of several conditions when the F1 flag 120 is set. The table in FIG. 2B identifies the condition codes and the corresponding conditions. When the contents of the condition code register 121 have the value zero, the start key 41 or stop key 42 has been depressed. When the contents of the condition code register have the value "1", a batch operation has been completed. If the contents of the condition code register have the value "2" or "3", one of several errors has occurred which will be explained below. When the contents of the condition code register have the value "5", the stop key has been depressed resulting in the assertion of the STOP signal on line 51. Finally when the contents of the condition code register have the value "4", the stop key has beed depressed while an error is being serviced.

An interrupt register 122 is loaded to identify the states of the signals on lines 50 through 57.

As has been noted, the OPT SENS optical sensing signal from sensor 18 is negated when a bill is passing over it, and is otherwise asserted. The signal is used for two purposes. First, it is used to identify the length of the bill passing through feed mechanism 9, and it is also used to determine when the input hopper 11 is empty. An index shut-off value register 123 is initially loaded with a prdetermined value. On the assertion of the INDEX signal from sensor 18, the contents of the index shut-off value register 123 are decremented in response to the receipt of the INDEX signal from sensor 18. Whenever the optical sense signal is negated, indicating that a bill is passing through the feed mechanism, the contents of the register 123 are restored to their initial value. If the contents of the index shut-off value register decrement to zero which occurs if no bill passes through the feed mechanism after a selected number of rotations of wheel 12, the system determines that the hopper 11 is empty and displays an appropriate message in display 33 (FIG. 1).

To determine whether the bills are of the required length, the system 10 also includes a timer counter (in one embodiment residing in peripheral adapter 30) which periodically generates timing signals. The microprocessor loads a value of zero in a bill length counter 130, which is the counter portion of the timer/counter in the above-noted embodiment, when the leading edge of a bill passes over optical sensor 18, first negating the OPT SENSE signal. In response to each assertion of the timing signal from the timer, the bill length counter increments. A bill length register 131 contains a value corresponding to the minimum number of timing pulses which would occur for a genuine bill and a bill tolerance register 132 contains a value corresponding to the difference between the minmum number of timing pulses in register 131 and the maximum number of timing pulses which would occur for a genuine bill. If the bill length counter 130 counts to the value contained in the bill length register before the OPT SENSE signal is again asserted, which occurs when the trailing edge of the same bill passes over optical sensor 18, the bill is at least the minimum required length. The microprocessor then resets the counter 130 and again increments in response to each assertion of the timing signal. If the OPT SENSE optical sense signal is again asserted, which occurs when the trailing edge of the bill passes over the sensor, the bill length counter increments to the value of the contents of the bill tolerance register 132, the length of the bill is within the required tolerance limits. Otherwise, if the OPT SENSE signal from optical sensor 18 was asserted before the bill length counter had counted up to the bill length value in register 131, the bill is too short, and, if the optical sense signal OPT SENSE signal is still negated when the bill length counter counts up to the bill tolerance value in register 132, the bill is too long.

FIGS. 3A through 5D detail the steps performed by a microprocessor 31 in controlling system 10. Figs. 3A through 3D define an executive program. FIGS. 4A through 4E detail the steps performed in response to an interrupt which occurs when a bill passes through feeder mechanism 9. FIGS. 5A through 5D detail the steps which are performed in response to the depression of a key on keyboard 40 or the occurence of an error interrupt in response to a signal on line 54 through 57.

After the power is turned on, the microprocessor first initializes the system 10 to a known state (step 200). All of the flags depicted in FIG. 2A are reset and an initialization message is displayed in display 33. The contents of the batch count, batch total, total 113, bill length 131 and bill tolerance registers 132 are cleared (step 201) and interrupts through port C 60 (FIG. 1) are disabled. The microprocessor 31 also enables peripheral adapter 30 (step 202) to assert the DSB KBD disable keyboard signal which inhibits the keyboard from transmitting signals over keyboard bus 46. When the start button 41 or stop butotn 42 are depressed (step 203) the microprocessor clears the F1 flag and the interrupt register (set 204), enables the peripheral adapter to negate the DSB KBD disable keyboard signal, which enables the keyboard to transmit signals over the keyboard bus 46, and also enables port C to receive the interrupt signals on lines 50 through 57 (step 205).

The microprocessor then checks the F1 flag (step 206). If the flag is set, the microprocessor sequences to step 207 in which it disables interrupts, turns on the motor, leaving the brake and clutch disengaged, disables the keyboard by enabling peripheral adapter 30 to transmit the DSB KBD disable keyboard signal. To turn on the motor, the microprocessor retrieves the state word 101, examines the MTR ON motor on field, and, if it is clear, inserts the value "1". The microprocessor then transmits the new state word to the peripheral adapter and loads it in its storage location. In response to the value of the MTR ON field, the peripheral adapter asserts the MOTOR ON signal to start motor 14 and enables the error interrupts from signals on lines 54–57.

Following steps 207, Microprocessor 31 then (step 10) enables the counters and interrupts and clears the F1 flag (step 211), enables the clutch (step 212). The microprocessor performs the clutch enabling operation in a way similar to the way, described above, in which it enabled the motor 14. Enabling the clutch starts the wheel 12 rotating to feed bills from hopper 11 to output tray 13. The microprocessor then establishes the value to be stored in index shut-off value register 123 (step 213).

At this point bills are being fed from input hopper 11 to output tray 13. In response to the passage of each bill, the microprocessor performs a count interrupt service routine as detailed in FIGS. 4A through 4E, which will be explained in detail below.

Returning to FIG. 3B, after step 213, the microprocessor system steps to step 214 in which it attempts to determine if an index pulse has been received. If the INDEX signal has not been received, it checks the F1 flag (step 215) to determine if a key has been depressed since step 211 and if not it returns to step 214. The microprocessor remains in the loop comprising steps 214 and 215 until either an index pulse is received or the F1 flag is set.

Assuming the F1 flag is not set, when an index pulse is received (step 214) the microprocessor decrements the contents of the index shutoff value register 123 (step 216) and tests its contents to determine if they equal zero (step 217). If they do equal zero, the input hopper 11 is empty. In response, the microprocessor disables interrupts (step 220), stops the timer and resets the counters (step 221), and stores a "zero" in the batch count register 107 (step 222). To ensure that the feed wheel 12 stops in a known position, the microprocessor waits until an index pulse is received, then waits a predetermined period of time and enables the brake to stop the wheel's rotation (step 223). The microprocessor then turns off the motor, clutch and brake and enables the display 33 to display the legend EMPTY (step 224). If mode flag 114 indicates that the system in the BATCH mode (step 225) when the operator removes the contents of output tray 13 causing sensor 19 to assert the OT EMPTY output tray empty signal, if the start key is not depressed (step 226) the microprocessor sequences to step 214 (FIG. 3B) and returns to the cycle.

If in step 225 the mode flag 114 indicates that the system is in a count mode, or if in step 226 the start key is depressed, the microprocessor cycles to the beginning of steps 207 (FIG. 3A) and repeats the loop. If in step 226 the start key is depressed, the microprocessor instead cycles to step 204 to again repeat the loop.

Figure 3A:
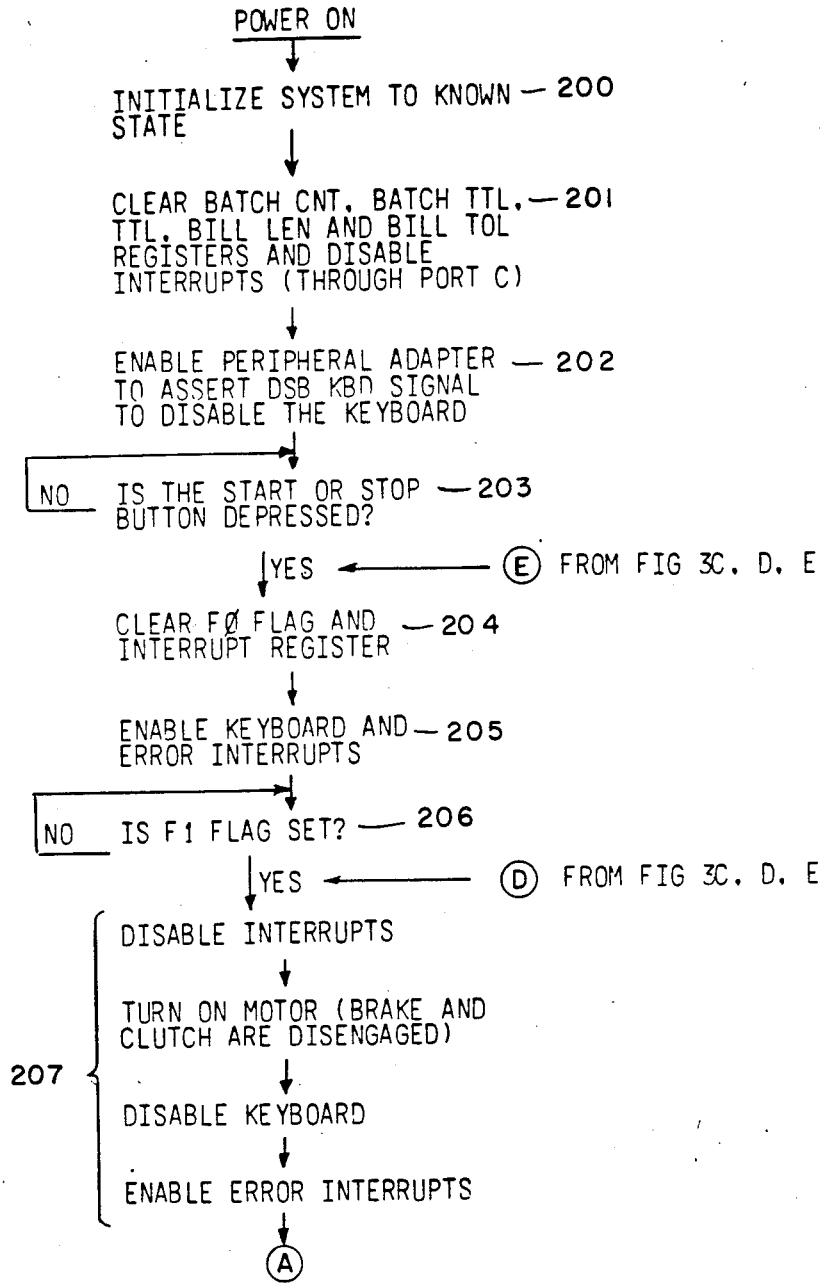
FIGS. 3A through 3E detail an executive program used by the microprocessor in performing several of its functions.
Figure 3B:
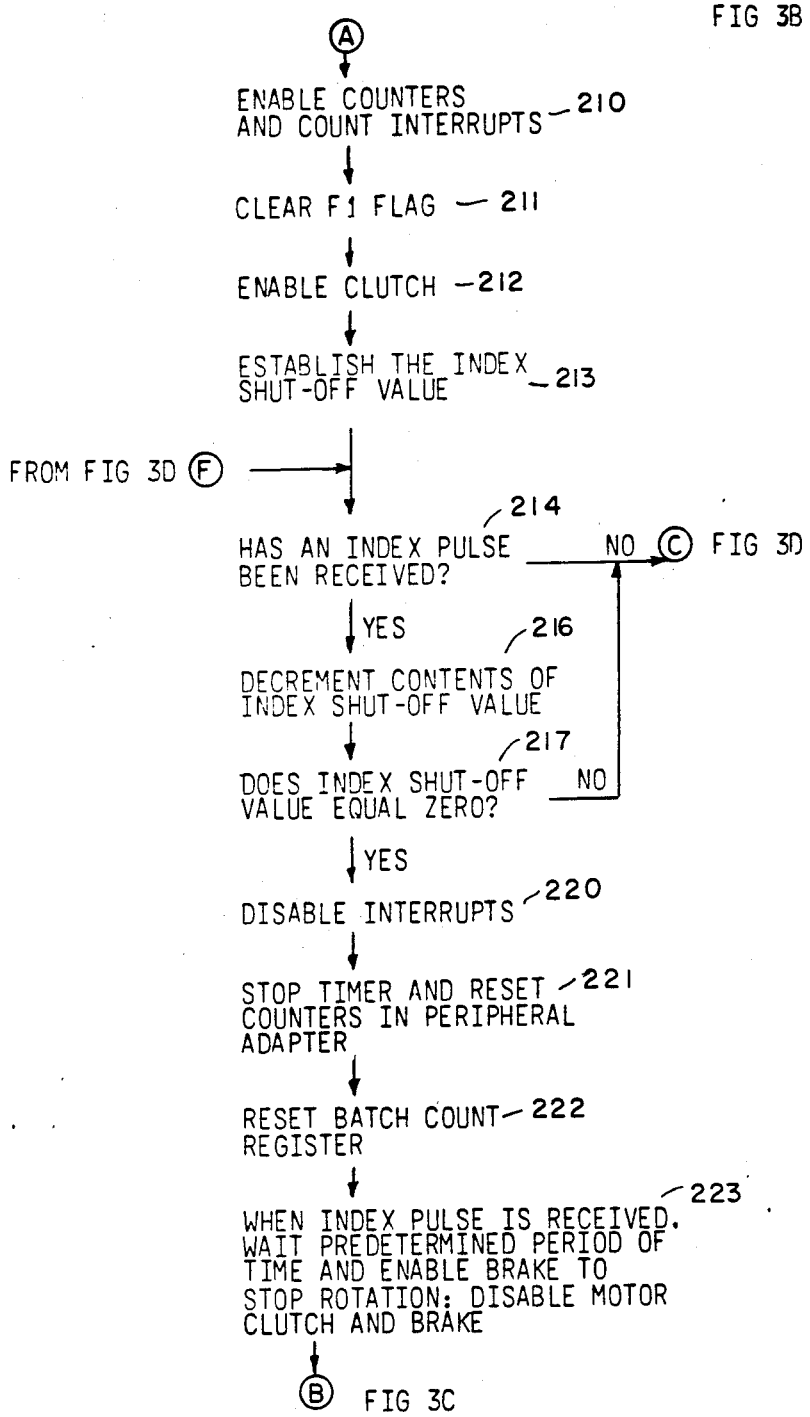
Figure 3C:
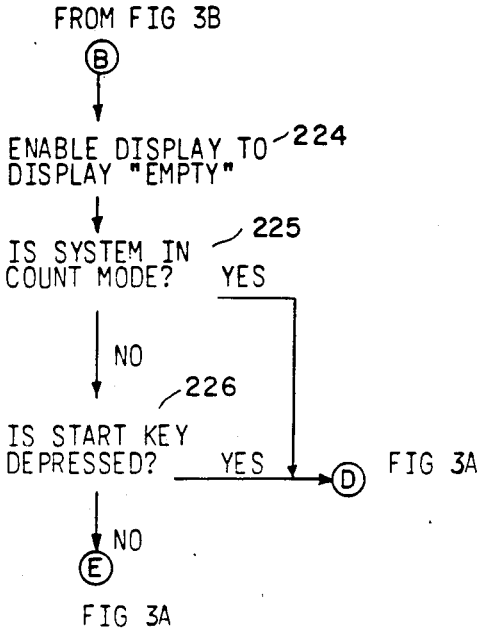
Figure 3D:
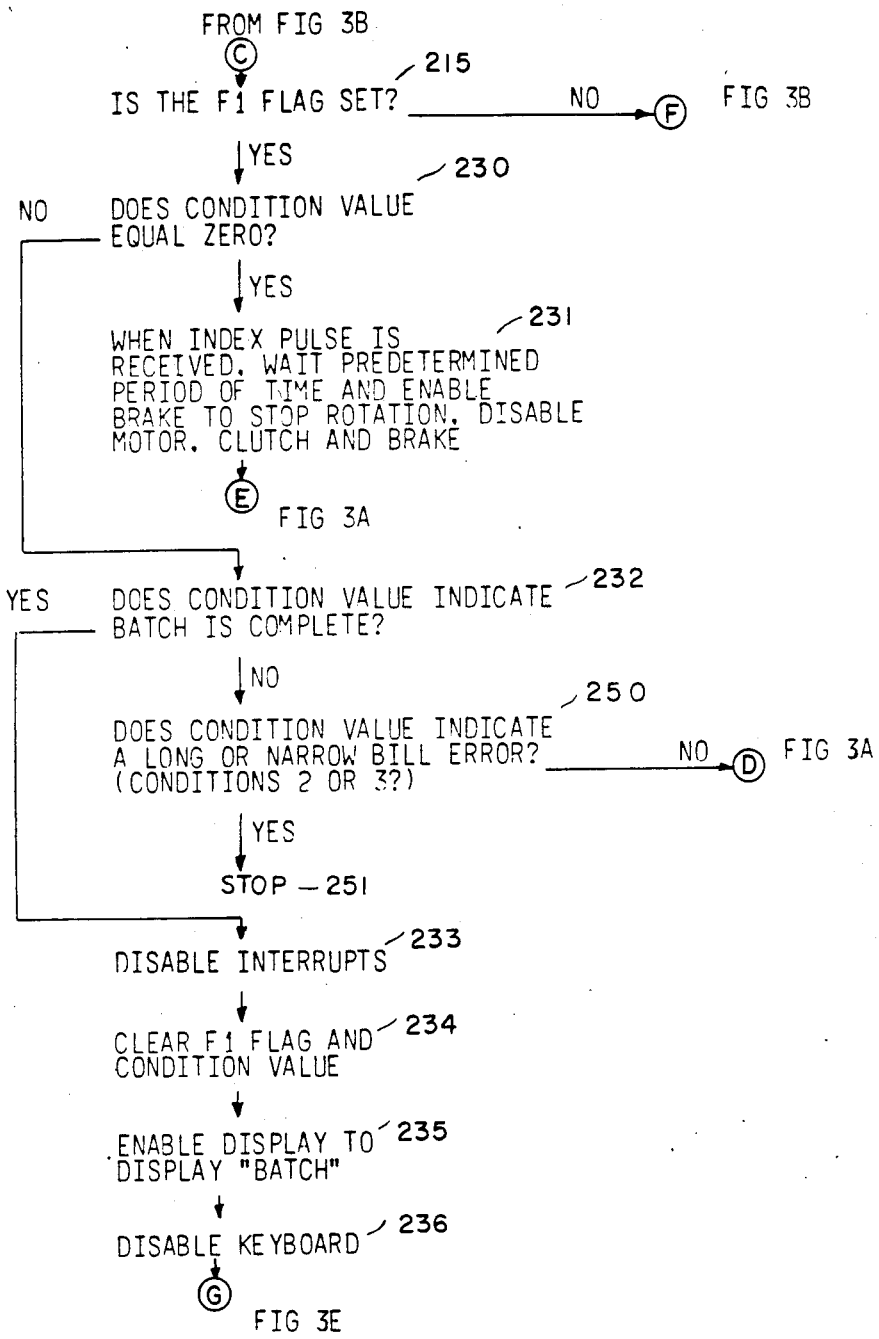
Figure 3E:
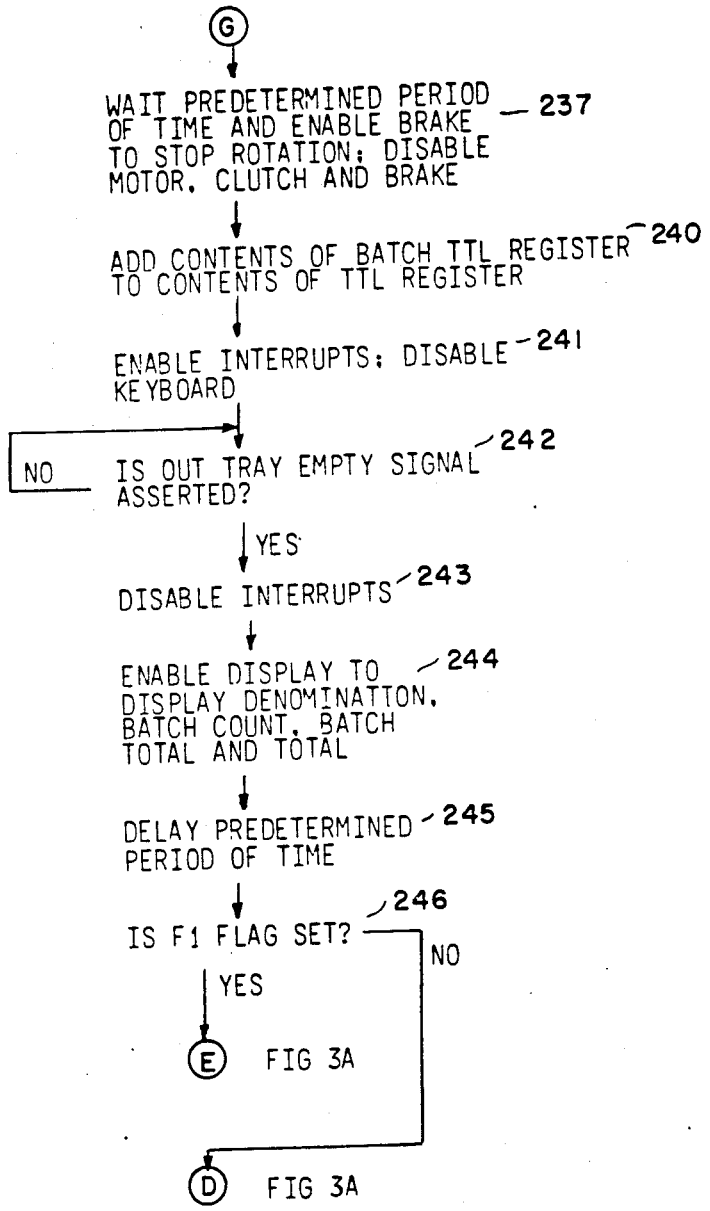

Returning to the loops defined by steps 214 or 217 (FIG. 3B) and 215 (FIG. 3D), the microprocessor tests the F1 flag (step 215). If it is set, a change in condition has occurred (FIG. 2B). If the start or stop keys have been depressed, as indicated by the condition code in condition value register 121 having the value "zero", (step 230) the microprocessor stops the rotation of the wheel 12 in a known orientation (step 231) after receiving the index pulse from sensor 18 (FIG. 1). The microprocessor then returns to step 204 (FIG. 3A).

If, instead, the condition code has the value "1" indicating the batch operation is complete (step 232), the microprocessor disables interrupts (step 233), clears the F1 flag 120 and the contents of condition value register 121 and enables the display 33 to display the legend "BATCH" (step 235) and enables peripheral adapter 30 to transmit the DSB KBD disable keyboard signal to inhibit keyboard 40 from transmitting signals over the keyboard bus 46 (step 236). Microprocessor then stops the rotation of wheel 12 (step 237) and adds the contents of the batch total register 112 to the total register 113 (step 240), enables interrupts (step 241) and waits until the operator has removed the bills form the output tray 13, which is indicated by the assertion of the OT EMPTY output tray empty signal (step 242). The microprocessor then disables interrupts through port C 60 (step 243), enables the display 33 to display the denomination specified by denomination code 111, the batch count, the batch total, and the contents of total register 113 (step 244). After a short delay (step 245), the system cycles to steps 204 or steps 207 depending on the state of the F1 flag 120 (step 246).

Returning to step 232 (FIG. 3D) if the value of the condition value register 121 is not "1" but instead has the values "2" or "3" (step 250) the system cycles to service routine and FIGS. 5A through 5D for the key stroke or error interrupt service routine.

Figure 4B:
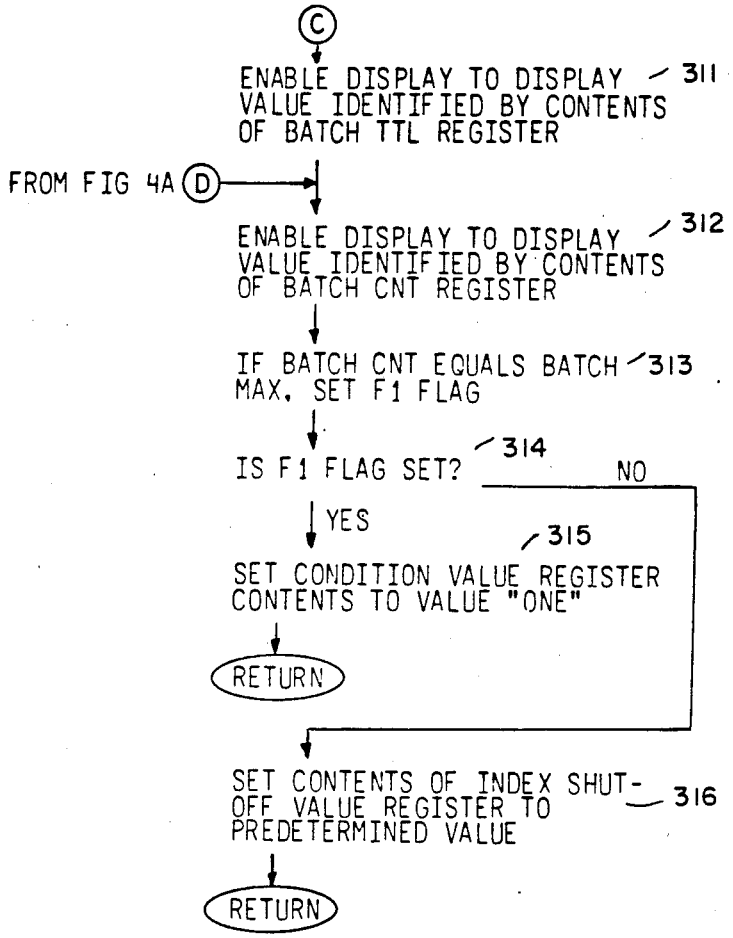
Figure 4C:
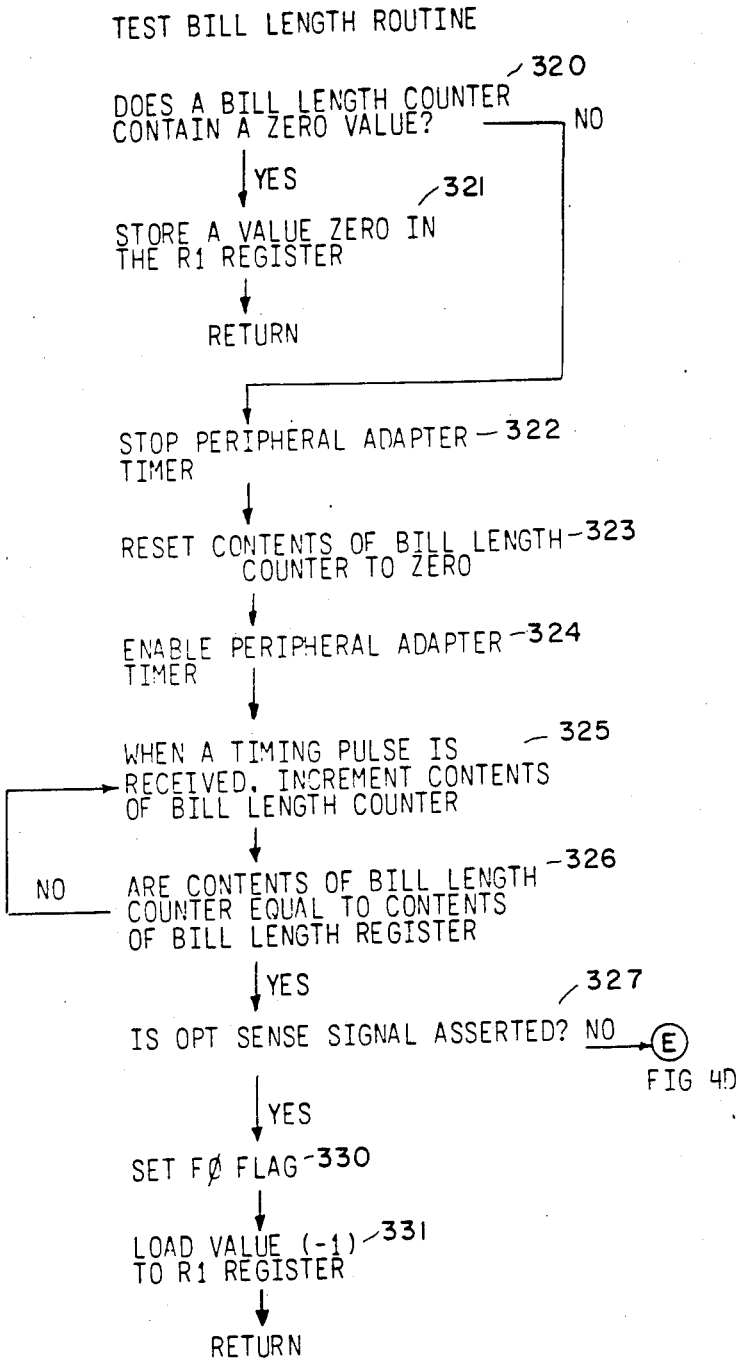

With reference to FIG. 4A, as a bill passes through feed mechanism 9, when the OPT SENSE optical sense signal is first shifted to a negated state, which indicates that the leading edge of the bill is passing over optical sensor 18, the microprocessor clears the F0 flag 124 (FIG. 2A) and an R1 register (not shown) in the microprocessor's general purpose registers (step 300). The system then performs a bill length test routine to determine if the bill has the proper length (step 301). The bill length test routine is illustrated in FIGS. 4C and 4D and will be described below. If the bill has the proper length, the F0 flag is clear in step 302. If a length error has occurred, indicating the bill is too short or long and possibly counterfeit, the F0 flag is set and contents of the R1 register have a non-zero value. If the bill is too short, the contents of the R1 register have the value (minus 1), and if the bill is too long, the contents of the R1 register have the value (plus 1). If the contents of the R1 register have the value zero (step 303) the bill has the proper length, and the microprocessor increments the contents of batch count register 107 (step 304) and tests mode flag 114 (step 305) to determine whether the system is in the count mode. If so, the microprocessor increments the contents of the total register 113 (step 306), clears the contents of the batch total register (step 307) and enables the display 33 to display the value identified by the contents of the total register 113 (step 310).

If in step 305 the mode flag indicated that the system was in a batch mode, the microprocessor cycles to step 311 (FIG. 4B) in which the display 33 is enabled to display the value identifed by the contents of the batch total register 112.

From either step 310 or 311, the system then steps to step 312 in which the display 33 is enabled to display the value identified by the contents of the batch count register 107. Microprocessor then compares the contents of the batch count register 107 with the batch maximum specified in register 110 (FIG. 2A) and, if they are equal, sets the F1 flag in step 313. If the F1 flag 120 is set (step 314), the microprocessor sets the contents of the condition value register 121 (FIG. 2A) to the value "1" (step 315) indicating that the batch operation is complete and returns to the executive loop depicted in FIGS. 3A through 3E. If the F1 flag is not set (step 314) the microprocessor sequences to step 316 in which it resets the contents of the index shutoff value register 123 (FIG. 2A) to the initial predetermined value and returns to the executive program. The microprocessor performs step 316 to ensure that the contents of the index shutoff value register 123 do not decrement to zero as long as bills are being transferred out of hopper 11.

The bill length test routine referenced in step 301 is illustrated in detail in FIG. 4C. With reference to that figure, the microprocessor first tests the contents of the bill length counter to determine if it has a zero value (step 320) and, if so, the microprocessor stores a zero value in the R1 general purpose register in microprocessor 31 (step 321). If the counter has a non-zero value, the microprocessor 31 stops a timer (step 322), resets the contents of the bill length counter 130 (FIG. 2A) to zero (step 323) and enables the timer to restart (step 324).

Each time a timing pulse from the timer is received, the bill length counter is incremented (step 325) and its value is compared to the contents of the bill length register 131 (step 326). Steps 325 and 326 form a loop in which the bill length counter is incremented in response to the receipt of a timing pulse, which are continually received as long as the bill is blocking sensor 18, until the value of the bill length counter equals the contents of the bill length register.

When the value of the bill length counter equals the contents of the bill length register, the microprocessor determines whether the OPT SENSE optical sense signal is asserted (step 327). If it is, the bill is too short, and the microprocessor sets the F0 flag (step 330) and loads the value (−1) into the R1 register (step 331) and returns to the step 302 (FIG. 4A). If the optical sense signal is not asserted in step 327, the microprocessor cycles to step 332 in which it determines whether the HALF, FOLD, JAM, and DOUBLE signals are asserted on lines 54 through 57. If so, the microprocessor loads the value (+1) into the R1 register (step 333) and returns to step 302 (FIG. 4A).

If in step 332, none of the error signals are asserted, the microprocessor cycles to step 334 to which the bill length counter 130 is reset. The microprocessor 31 then enables the timer (step 335), and the system enters a loop consisting of steps 336 and 337. When each timing pulse is received, the bill length counter are incremented and compared to the contents of the bill tolerance register 132 (FIG. 2A). If the OPT SENSE optical sense signal is asserted (step 340) when the value of the counter equals the contents of the bill tolerance register, the trailing edge of the bill has passed over the sensor within the selected length tolerance limits and the system loads the value "0" into the R1 register (step 341) and returns.

If the OPT SENSE optical sense signal is not asserted by the time the bill length counter equals the contents of the bill's tolerance register, the length of the bill is outside of the tolerance limits, that is, it is too long, and the system sets the F0 register (step 342) loads the value (+1) into the R1 register (step 343) and returns to step 302 (FIG. 4A).

Figure 4E:
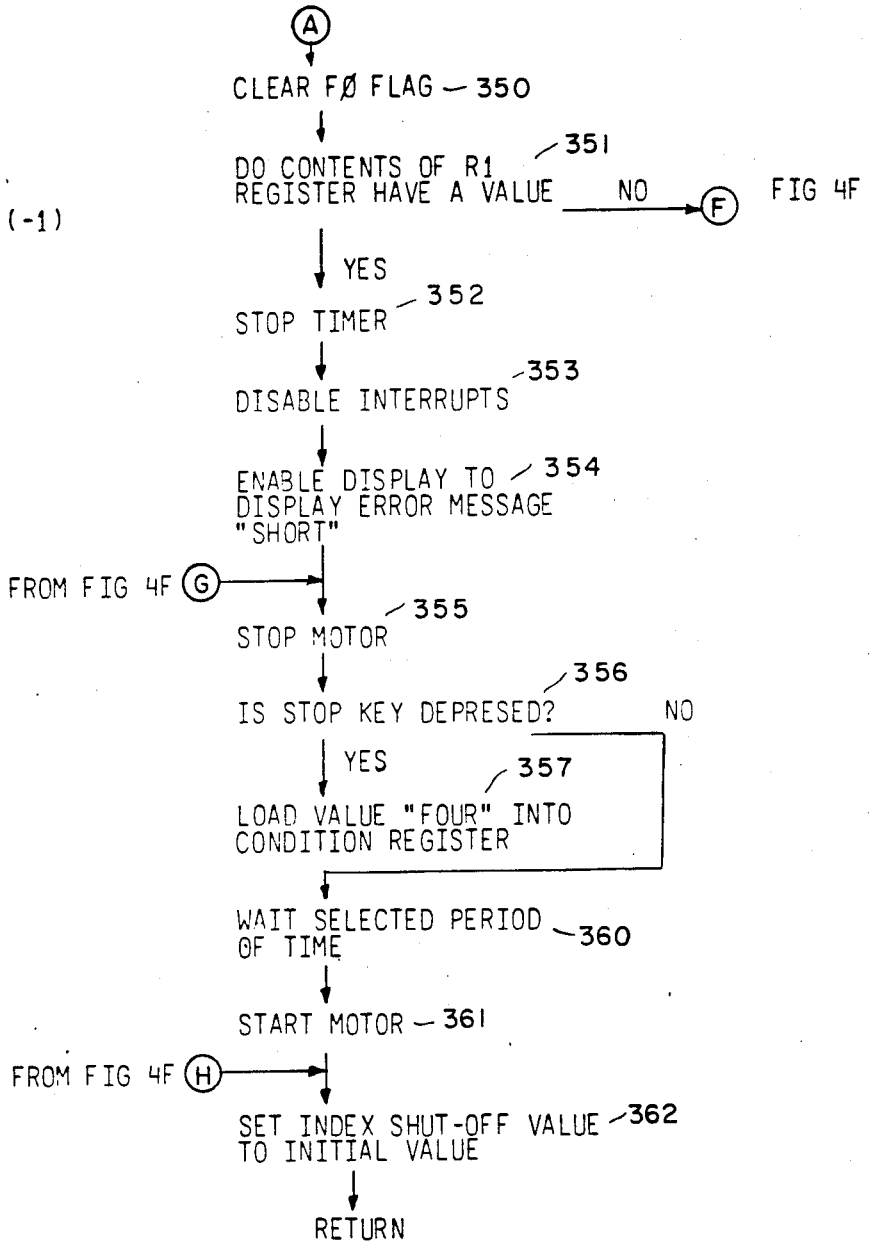

Returning to step 302 (FIG. 4A) if the F0 flag is set indicating that there is a length error, the system cycles to the sequence depicted on FIG. 4E. The microprocessor clears the F0 flag 124 (step 350) and tests the contents of the R1 register (step 351). If the contents of the R1 register have the value (−1) (in which the bill is short), the microprocessor stops the timer in the peripheral adapter (step 352), disables interrupts (step 353), and enables the display 33 to display the error message "SHORT" (step 354). The microprocessor then stops the motor 14 (step 355) and tests the stop signal on line 51 (step 356). If the stop signal is asserted, indicating that the stop key is depressed, the microprocessor loads the value "4" into the condition value register 121 (step 357) and returns. If the stop button 42 is not depressed (step 356), the microprocessor waits a selected period of time (step 360), restarts the motor (step 361) and resets the contents of the index shutoff value register to its initial value (step 362) and returns to the executive routine.

Figures 4E, 4F:
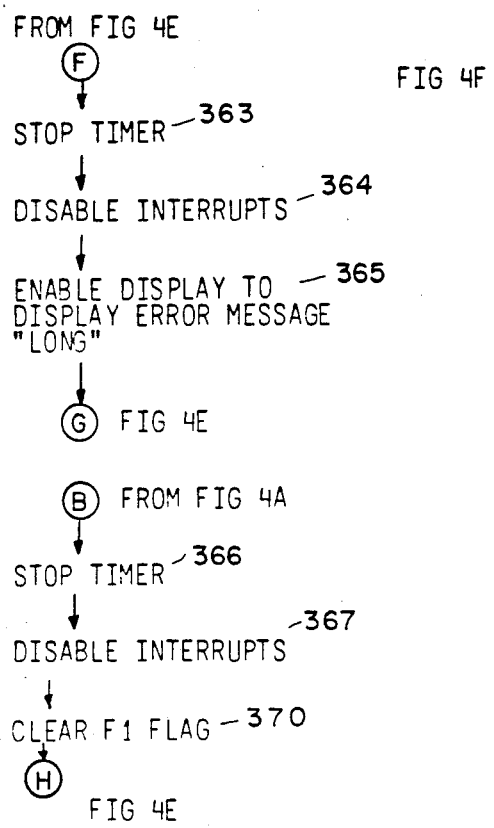

If in step 351 (FIG. 4E) the contents of the R1 register have a value of other than (−1), the microprocessor, instead of performing steps 352 through 354 performs the steps depicted on FIG. 4F. Following step 351, the microprocessor stops the timer (step 363), disables interrupts (364) and enables the display to display the error message "LONG" (step 365). The microprocessor then cycles to step 355 and continues.

Returning to FIG. 4A, if in step 302, the F0 flag is not set, but, in step 303 the system determines that the contents of the R1 register were other than "0" the system performs a sequence also depicted on FIG. 4F. It initially stops the timer in the peripheral adapter 30 (step 366), disables interrupts from port C 60 (FIG. 1) (step 367). It then clears the F1 flag 120 (step 370) and cycles to step 362 (FIG. 4E) to reset the contents of the index shutoff value register 123 (FIG. 2A) to the initial value before returning to the executive sequence depicted in FIGS. 3A through 3D.

When the microprocessor 31 receives an interrupt signal through its ports C 60, it retrieves all of the signals from the port and loads certain selected values into its general purpose registers (step 400). It then determines the source of the interrupt based on the particular signal on lines 50 through 57 which are asserted and transfers to the proper service routine (step 401).

If the start button is depressed, the start signal is asserted on line 50 and the microprocessor then clears the batch count and batch total registers 107 and 112 (step 402, FIG. 5A) and enables the display to display the values of the contents of the denomination register 111, batch count and batch total registers 107 and 112 (step 403). The contents of the condition value register 121 are set to the value "zero" (step 404). After the START signal is negated (step 405) the microprocessor sets the contents of the index shutoff value register 123 to its initial value (step 406) and the microprocessor returns to the executive routine (FIGS. 3A through 3E).

Figure 5A:
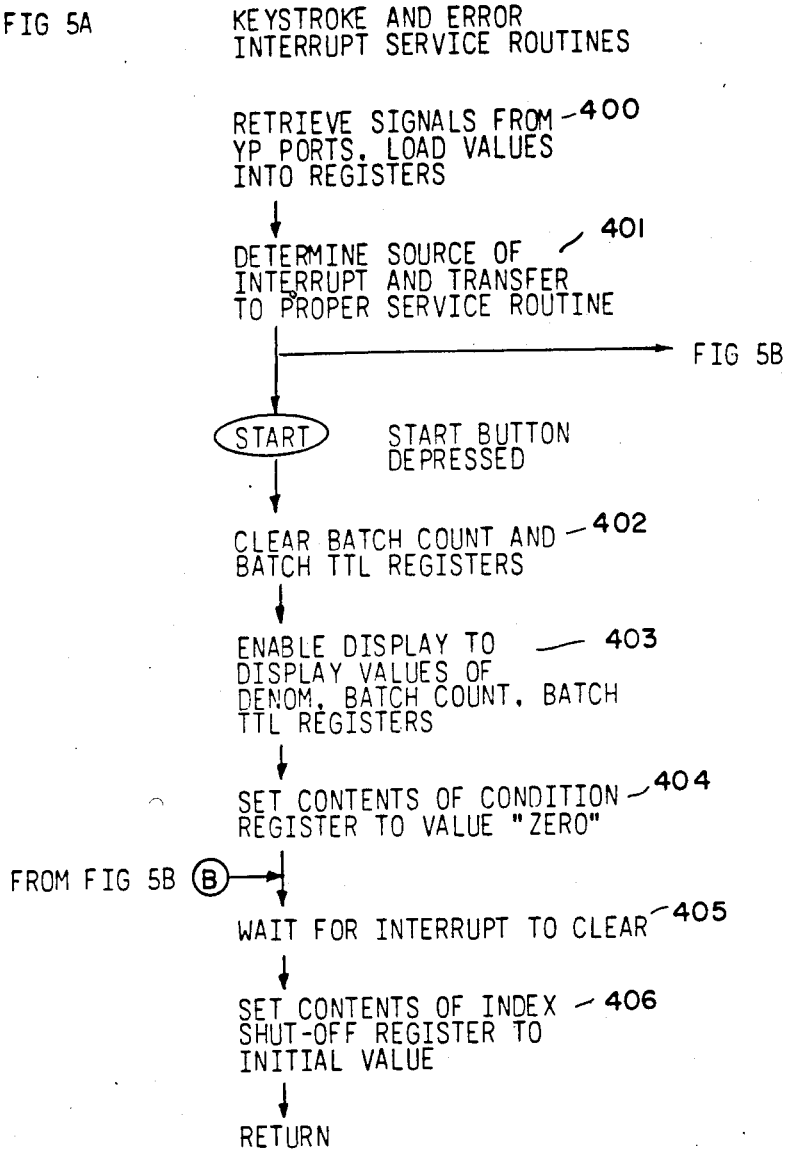
Figure 5B:
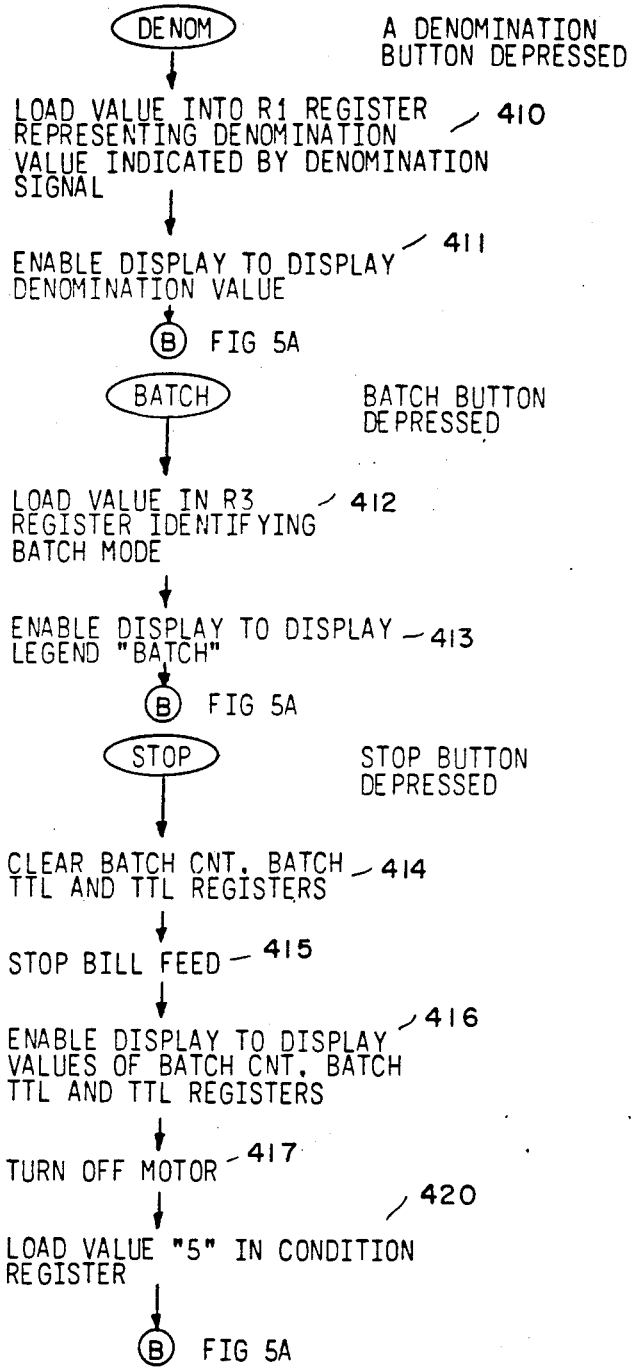

With reference to FIG. 5B, if the DENOM denomination signal is asserted on line 53, which occurs when one of the denomination buttons 44 is depressed, the microprocessor, through port B 47 (FIG. 1) retrieves the identification of the denomination button which has been depressed and loads it into an R2 register in the microprocessor's general purpose register set (step 410). The microprocessor then enables the peripheral adapter 30 to, in turn, enable display 33 to display the denomination value (step 411). The microprocessor then sequences to step 405 (FIG. 5A) prior to returning to the executive routine.

If the batch button 43 is depressed, a code is loaded into register R3 identifying the fact that the system is in a BATCH mode (step 412). The display 33 is enabled to display the legend "batch" (step 413) and the microprocessor sequences to step 405 prior to returning to the executive routine.

If the stop button 42 is depressed, causing the assertion of a STOP signal on line 51, the microprocessor 31 clears the batch count register 107, batch total register 112, and the total register 113 (step 414). The microprocessor enables the peripheral adapter 30 BILL FEED ON signal causing the bill feed 20 to stop feeding bills from hopper 11 to feed wheel 12 (step 415), and the display 33 is enabled to display the values of the contents of the batch count, batch total, and total registers (step 416). The microprocessor then turns off the motor 14 (step 417) and loads the value "5" in condition register 121 (step 420). The microprocessor then steps to step 405 before returning to the executive routine.

Figure 5D:
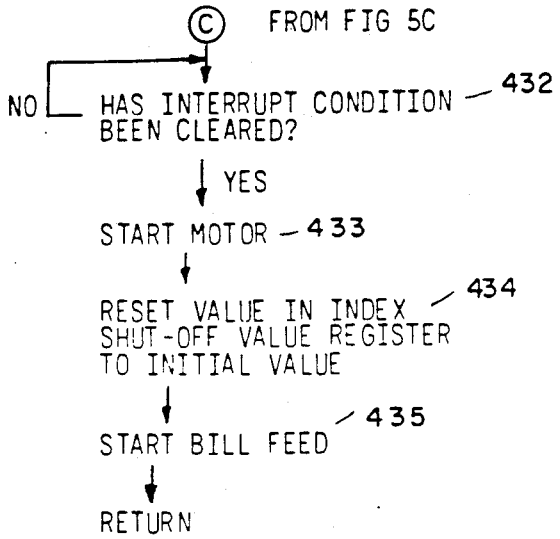

The operations performed by the microprocessor 31 in response to the receipt of a HALF signal, a FOLD signal, a JAMB signal, and a DOUBLE signal on lines 54 through 57 will be described in connection with FIGS. 5C and 5D. After receiving any of these signals, the microprocessor first stops the timer in the peripheral adapter 30 (steps 421A through 421D) and disables interrupts through port C 60 (steps 422A through 422D). The microprocessor then enables the display 33 to display an appropriate legend (steps 423A through 423D) and negates the BILL FEED ON signal (step 424) which stops bill feed 20. The microprocessor then enables the peripheral adapter to assert the DSB KBD disable keyboard signal (step 425) and, after a predetermined period of time (step 426) stops motor 14 (step 427). If the stop key 42 has been depressed (step 430) the value "4" is loaded into the condition value register 121

(step 431) and the microprocessor returns to the executive program depicted in FIGS. 3A through 3D.

If the stop key has not been depressed (step 430) the microprocessor steps to step 432 in which it waits until the asserted signals on lines 54 through 57 are negated, after which the microprocessor restarts motor 14 (step 433), resets the value in the index shutoff value register 123 to its initial value (step 434), enables the peripheral adapter to assert the BILL FEED ON signal restarting the bill feed 20 (step 435) and returns to the executive routine.

In some currencies the different denominations have bills of different lengths, and the system depicted in FIG. 1 can be used to distinguish between and identify the different currencies by their lengths. In this case, the bill length and bill tolerance registers 131 and 132 will be replaced by a table as depicted in FIG. 6 having a plurality of entries identifying the lengths and tolerances for the different denominations arranged in order of increasing lengths. Instead of a denomination code register 111, a denomination code counter 111A is provided which points to the successive entries in the table. The test bill length routine on FIGS. 4C and 4D is modified so that, if the OPT SENSE optical sense signal is negated after the bill length counter 130 has reached the upper end of the bill tolerance of a particular denomination, instead of noting that the bill is too long, the denomination code counter 111A will be incremented to point to the table entry for the next denomination and the process is repeated. When a condition is sensed in which the OPT SENSE optical sense signal is negated when the bill length counter 130 has counted to the value of the bill length in the entry for a particular denomination, and the OPT SENSE signal is asserted when the bill length counter is subsequently counted up to the bill tolerance value for that same denomination, the denomination code counter is stopped and its value identifies the particular denomination for that bill. Using this mechanism, bills of different denominations can be mixed in the input stack in input hopper 11, and the system may maintain a running total of the amount of currency passing therethrough.

The foregoing description is limited to a specific embodiment of this invention. It will be apparent, however, that this invention can be practiced in systems having diverse basic construction or that use different internal circuitry or programming than is described in the specification with the attainment of some or all of the advantages of this invention. Therefore, it is the object of the appended claims to cover all such variations as come within the true spirit and scope of this invention.

What is claimed as new and desired to be secured by Letters Patent of the United States is:

1. A control system for a cash counting machine including bill feed means comprising an input hopper for receiving a stack of bills, an output tray and transfer means for transferring each bill individually from said input hopper to said output tray to define a bill feed path, bill sensing means proximate said bill feed path for generating a bill feed signal in response to the passage of the leading edge of a bill thereby, and for negating said bill feed signal in response to the passage of the trailing edge of the bill thereby, said control system including:

A. timing signal generating means for generating a timing signal;

B. length storage means including minimum length entry means for storing a length value and tolerance entry means for storing a tolerance value;

C. length counter means connected to said timing signal generating means for incrementing in response to the receipt of said timing signal;

D. comparison means for iteratively comparing the value of said length counter means selectively to the contents of either said minimum length entry means or said tolerance entry means;

E. means for resetting said length counter means after said comparison means determines that the value of said length counter means equals the contents of the selected minimum counter means or said tolerance storage means;

F. comparison control means for controlling the selection of the minimum length entry means and said tolerance entry means by said comparison means, said comparison control means initially selecting said minimum length entry means and, when said resetting means resets the length counter means, thereafter selecting said tolerance storage means; and G. detecting means for detecting the state of said bill feed signal after said comparison means determines that the value of said length counter means equals the contents of said minimum counter means or said tolerance storage means and for enabling said control means to perform predetermined operations in response thereto.

2. A control system as defined in claim 1 wherein said length storage means comprises a plurality of denomination entries each including a minimum length entry means and a tolerance entry means and said control means further includes:

A. denomination counter means for iteratively pointing to said denomination entries;

B. means connected to said detecting means for incrementing said denomination counter means if said bill feed signal is negated when the value of said length counter means equals the contents of the tolerance entry means in the denomination entry identified by said denomination counter means.

3. A control system as defined in claim 1 further comprising:

A. mode indicating means having a plurality of conditions each indicating one of a plurality of operating modes;

B. bill count means for storing a predetermined number;

C. transfer storage means for storing a value identifying the number of bills that have been transferred by said bill feed means; and D. means responsive to a first condition of said mode indicating means for enabling said bill feed means to transfer all of the bills in said input hopper to said output tray and for incrementing the contents of said transfer storage means in response to the transfer of each bill, and responsive to a second condition of said mode indicating means for enabling said bill feed means to iteratively transfer a bill from said input hopper to said output tray, increment the contents of said transfer storage means, compare the contents of said transfer storage means to the contents of said bill count means and stop said iterations if the contents of said bill count means equals the contents of said transfer storage means to thereby enable said bill feed means to transfer the number of bills identified by said bill count means to said output tray.

4. A control system as defined in claim 3 wherein said cash counting machine further comprises operator input means and display means both connected to said control system, said operator input means including operator controlled mode input means for establishing the condition of said mode indicating means, said control system further including means for enabling said display means to display the operating mode as identified by the condition of said mode indicating means.

5. A control system as defined in claim 4 wherein said operator input means further includes operator controlled denomination input means for inputting a denominating value, said control system further including denomination storage means for storing said denomination value, running total storage means for storing a running total value and means responsive to the transfer of each bill by said bill feed means for adding the contents of said denomination storage means to the contents of said running total storage means for maintaining the total value of bills transferred by said bill transfer means.

6. A control system as defined in claim 5 further including means for enabling said display means to display the denomination value and running total as contained in said respective storage means.

7. A control system as defined in claim 3 wherein said bill feed means further includes bill sensing means for generating a transfer signal in response to the transfer of a bill through the bill feed means, operational sensing means for periodically transmitting an operation signal while said bill transfer means is operational, said control system further including:

A. count storage means for storing a preselected initial count value,

B. decrementing means connected to said count storage means and said operational sensing means for decrementing the contents of said count storage means in response to the receipt of an operation signal;

C. means responsive to the contents of said count storage means having a selected lower count value for disabling said bill feed means; and D. resetting means connected to said count storage means and said bill sensing means for resetting the contents of said count storage means to said preselected count value in response to the receipt of a transfer signal.

8. A cash counting machine including:

A. bill feed means comprising:

i. an input hopper for receiving a stack of bills;

ii. an output tray; and iii. transfer means for transferring each bill individually from said input hopper to said output tray to define a bill feed path;

B. bill sensing means proximate said bill feed path for generating a bill feed signal in response to the passage of the leading edge of a bill thereby, and for negating said bill feed signal in response to the passage of the trailing edge of the bill thereby;

C. control means including:

i. timing signal generating means for generating a timing signal;

ii. length storage means including minimum length entry means for storing a length value and tolerance entry means for storing a tolerance value;

iii. length counter means connected to said timing signal generating means for incrementing in response to the receipt of said timing signal;

iv. comparison means for iteratively comparing the value of said length counter means selectively to the contents of either said minimum length entry means or said tolerance entry means;

v. means for resetting said length counter means after said comparison means determines that the value of said length counter means equals the contents of the selected minimum counter means or said tolerance storage means;

vi. comparison control means for controlling the selection of the minimum length entry means and said tolerance entry means by said comparison means, said comparison control means initially selecting said minimum length entry means and, when said resetting means resets the length counter means, thereafter selecting said tolerance storage means; and vii. detecting means for detecting the state of said bill feed signal after said comparison means determines that the value of said length counter means equals the contents of said minimum counter means or said tolerance storage means and for enabling said control means to perform predetermined operations in response thereto.

9. A cash counting machine as defined in claim 8 wherein said length storage means comprises a plurality of denomination entries each including a minimum length entry means and a tolerance entry means and said control means further includes:

A. denomination counter means for iteratively pointing to said denomination entries;

B. means connected to said detecting means for incrementing said denomination counter means if said bill feed signal is negated when the value of said length counter means equals the contents of the tolerance entry means in the denomination entry identified by said denomination counter means.

10. A cash counting machine as defined in claim 8 further comprising:

A. mode indicating means having a plurality of conditions each indicating one of a plurality of operating modes;

B. bill count means for storing a predetermined number;

C. transfer storage means for storing a value identifying the number of bills that have been transferred by said bill feed means; and D. means responsive to a first condition of said mode indicating means for enabling said bill feed means to transfer all of the bills in said input hopper to said output tray and for incrementing the contents of said transfer storage means in response to the transfer of each bill, and responsive to a second condition of said mode indicating means for enabling said bill feed means to iteratively transfer a bill from said input hopper to said output tray, increment the contents of said transfer storage means, compare the contents of said transfer storage means to the contents of said bill count means and stop said iterations if the contents of said bill count means equals the contents of said transfer storage means to thereby enable said bill feed means to transfer the number of bills identified by said bill count means to said output tray.

11. A cash counting machine as defined in claim 10 wherein said cash counting machine further comprises operator input means and display means both connected to said control system, said operator input means including operator controlled mode input means for establishing the condition of said mode indicating means, said control system further including means for enabling said display means to display the operating mode as identified by the condition of said mode indicating means.

12. A cash counting machine as defined in claim 11 wherein said operator input means further includes operator controlled denomination input menas for inputting a denominating value, said control system further including denomination storage means for storing said denomination value, running total storage means for storing a running total value and means responsive to the transfer of each bill by said bill feed means for adding the contents of said denomination storage means to the contents of said running total storage means for maintaining the total value of bills transferred by said bill transfer means.

13. A cash counting machine as defined in claim 12 further including means for enabling said display means to display the denomination value and running total as contained in said respective storage means.

14. A cash counting machine as defined in claim 10 wherein said bill feed means further includes bill sensing means for generating a transfer signal in response to the transfer of a bill through the bill feed means, operational sensing means for periodically transmitting an operational signal while said bill transfer means is operational, said control system further including:

A. count storage means for storing a preselected initial count value,

B. decrementing means connected to said count storage menas and said operational sensing means for decrementing the contents of said count storage means in response to the receipt of an operation signal;

C. means responsive to the contents of said count storage means having a selective lower count value for disabling said bill feed means; and D. resetting means connected to said count storage means and said bill sensing means for resetting the contents of said count storage means to said preselected count value in response to the receipt of a transfer signal.

* * * * *